US006007341A

United States Patent [19]

Koch

[11] Patent Number: 6,007,341

[45] Date of Patent: Dec. 28, 1999

[54] GOLF SWING TRAINING DEVICE

[76] Inventor: Robert C. Koch, 4707 Salem's Way, Medina, Ohio 44256

[21] Appl. No.: 09/015,160

[22] Filed: Jan. 29, 1998

[51] Int. Cl.[6] ..... A63B 69/36

[52] U.S. Cl. ..... 434/252; 473/232

[58] Field of Search ..... 473/316, 231, 473/232, 322, 257, 219; 434/252; 273/193 R, 194 R, 186.1, 186.2; 403/119, 102, 62, 63, 53

[56] References Cited

U.S. PATENT DOCUMENTS

| | | | |
|---|---|---|---|
| 1,471,794 | 10/1923 | Leven | 273/186 |
| 1,524,196 | 1/1925 | Matthews | 273/29 |
| 1,529,305 | 3/1925 | Gatke | 273/186 |
| 1,990,281 | 2/1935 | Grelle | 273/186 |
| 2,005,915 | 6/1935 | Grelle | 273/186 |
| 2,158,211 | 5/1939 | Aitken | 273/186 |
| 2,223,647 | 12/1940 | Stumpf | 273/186 |
| 2,497,237 | 2/1950 | Reineking | 273/193 |
| 3,033,575 | 5/1962 | Hause | 273/193 |
| 3,229,980 | 1/1966 | Silberman | 273/186 |
| 3,606,340 | 9/1971 | Tiller | 273/186 |
| 3,679,205 | 7/1972 | Finkle et al. | 273/29 |
| 4,118,033 | 10/1978 | Miyamoto | 273/186 |
| 4,367,871 | 1/1983 | Schiefer | 273/29 |
| 4,479,653 | 10/1984 | Woodson | 273/186 |
| 4,854,585 | 8/1989 | Koch et al. | 273/193 |
| 4,856,782 | 8/1989 | Cannan | 273/80 |
| 5,195,748 | 3/1993 | Koch et al. | 273/186 |
| 5,277,427 | 1/1994 | Bryan et al. | 273/186.2 |
| 5,489,100 | 2/1996 | Potter | 273/186.2 |

FOREIGN PATENT DOCUMENTS

| | | | |
|---|---|---|---|
| 2103492 | 2/1983 | United Kingdom | A63B 69/36 |

*Primary Examiner*—Kien T. Nguyen
*Attorney, Agent, or Firm*—Renner, Otto, Boiselle & Sklar, P.L.L.

[57] ABSTRACT

A golf swing training device includes a plurality of elongate shaft sections connected by a hinge apparatus having a plurality of distinct hinge axes, a club head secured to one of the shaft sections, and a grip connected to another of the shaft sections.

17 Claims, 1 Drawing Sheet

GOLF SWING TRAINING DEVICE

FIELD OF THE INVENTION

The invention relates generally to training devices for improving a golfer's golf game, and more specifically to a training club for improving the golfer's swing.

BACKGROUND OF THE INVENTION

There are few sports that attract as broad a range of people as golf. Because of the nature of golf most everyone can enjoy the sport but very few have mastered it.

One of the most basic and most difficult aspects of the game is developing a proper golf swing. A desired golf swing is smooth with the golf club remaining in a constant plane throughout the swing. The golf club is taken away from the ball at a smooth, even tempo to the top of the backswing. The downswing follows with the club staying in the same plane as in the backswing with the club head being smoothly accelerated through impact with the golf ball.

While the basic proper golf swing is simple to described and to visualize, it is very difficult for all but the most accomplished golfers to achieve. Consequently, there are countless devices on the market for improving a golfer's swing. While many of these devices help to varying degrees, most only apply to small aspects of the swing.

One golf swing training device that has met with critical acclaim from golf professionals and golf publications alike is the Medicus® training club marketed by RM&G Products. The Medicus® training club looks very similar to a conventional golf club. When swung properly the Medicus® training club indeed acts like a conventional golf club and can be used to hit a golf ball. When the training club is swung improperly, however, such as when it is not swung at a relatively even tempo, it provides instant feedback to the golfer of the swing defect.

The Medicus® training club includes a conventional club head and grip, but has an adjustable hinge interposed in the shaft of the club permitting the shaft to articulate or break at the point in the swing that club is not being swung properly. The club offers the advantage that it provides immediate feedback and can be swung almost anywhere without requiring the actual striking of a golf ball. The hinge is adjustable to allow golfers of varying skill levels to use the training club. The Medicus® training club is disclosed in U.S. Pat. Nos. 4,854,585 and 5,195,748 which are incorporated herein by this reference.

While the Medicus® training club and the clones of the Medicus® training club have helped countless golfers to develop a better golf swing by correcting certain defects in their swings, it would be desirable to have a training device that corrected these and other swing defects to further promote a good swing.

SUMMARY OF THE INVENTION

The present invention is adapted to facilitate the detection of multiple swing defects by providing a hinge assembly having plurality of hinge axes in the shaft of a golf swing training device resembling a golf club. Preferably, the shaft of the device breaks or articulates about at least one of the axes when the device is swung improperly to indicate to the golfer the swing defect. Each hinge axes may be adapted to facilitate the detection of a different swing imperfection, for example, one axis may be positioned to detect flaws in the backswing, while the other axis may be positioned to detect a swing likely to cause a slice.

In accordance with one aspect of the invention, a golf swing training device includes a golf club having a shaft that is hinged to articulate around two distinct axes.

In accordance with another aspect of the invention a golf swing training device includes a plurality of elongate shaft sections connected by a plurality of hinge sections enabling the shaft sections to articulate about a plurality of distinct axes, a club head secured to one of the shaft sections, and a grip connected to another of the shaft sections.

In accordance with still another aspect of the invention, a golf swing training device includes a plurality of elongate shaft sections connected by a hinge apparatus having a plurality of distinct hinge axes, a club head secured to one of the shaft sections, and a grip connected to another of the shaft sections.

In general, the invention comprises the foregoing and other features hereinafter fully described and particularly pointed in the claims, the following description and the annexed drawings setting forth in detail a certain illustrated embodiment of the invention, this being indicative, however, of but one of the various ways in which the principles of the invention may be employed.

DETAILED DESCRIPTION OF THE INVENTION

Figure 1:
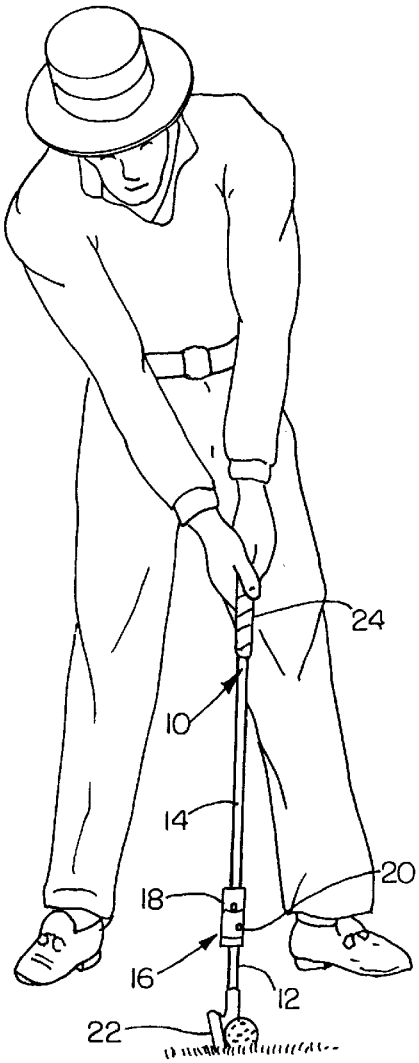
FIG. 1 is an illustration of a golfer holding the training club of the present invention.

With reference to the figures in general and initially to FIG. 1 in specific, there is shown a golf swing training device 10 as held by a golfer before the beginning of a swing, also called at address. The training device 10 includes lower and upper elongate shaft sections 12 and 14, respectively, connected at their confronting ends by a hinge apparatus 16 having two distinct hinge axes 18 and 20. At the lower end of the lower shaft section 12 is secured a club head 22, while at the upper end of the upper shaft section 14 is secured a grip 24 as in a conventional golf club. Preferably, the hinge assembly 16 is located at or near the center of gravity of the training device 10, but may be located at other places along the length of the shaft.

The shaft sections 12 and 14, the club head 22 and the grip 24 may be of similar or the same design as like components in a conventional golf club. The club head 22 may be a five iron, for example, a driver, or other club head configuration.

The hinge assembly 16 may be constructed of any number of materials, such as stainless steel or aluminum, and in a number of different designs which result in a hinge assembly which is preferably strong and lightweight, adaptable to connect to the shaft sections 12 and 14, and which has two distinct rotational hinge axes 18 and 20. It is also desirable that the hinge assembly 16 include a biasing element, discussed more fully below, which biases the hinge assembly to maintain the shaft sections 12 and 14 in longitudinal alignment during a relatively proper golf swing. The biasing element may be adjustable to vary the sensitivity of the hinge to articulate at different swing imperfection magnitudes.

The hinge axes 18 and 20 may be rotationally offset relative to one another to varying degrees, for example, zero to 25 degrees (designated by A in FIG. 2), but preferably generally 15 degrees, depending on the swing error the training device is adapted to detect. An average golfer typically swings the club during the downswing with the club head 22 following along an outside to inside swing path, rather than in a constant plane, and thus hits the ball so as to impart a spin on the ball that causes the ball to fly in an arcing trajectory called a slice. For such a golfer one hinge axis, say the axis 18, may extend generally perpendicular to the plane of a proper swing while the hinge axis 20 may be rotationally offset approximately 15 degrees in the direction of the eventual ball flight.

The hinge axis 18 lying perpendicular to a proper swing plane functions to detect swing imperfections which cause a torque on the hinge assembly 16 exceeding the centrifugal force generated by the swing of the club and the biasing force from the biasing element. For example, if the training club 10 is accelerated at an uneven rate generally in the swing plane, such as may be caused by improper movement of the arms or hands or body, the shaft sections 12 and 14 will desirably articulate about the hinge axis 18 providing immediate feedback to the golfer of the swing defect. In the case of an outside to inside swing, the training club 10 will be more likely to articulate around the hinge axis 20 to indicate the swing fault than if the training device only included a single hinge axis 18, because the hinge axis 20 will lie closer to perpendicular to this improper swing path. Consequently, the incorporation of a hinge assembly 16 having two distinct hinge axes 18 and 20 allows the training club 10 of the present invention to detect more swing faults than a similar training club with a single hinge axis.

Figure 3:
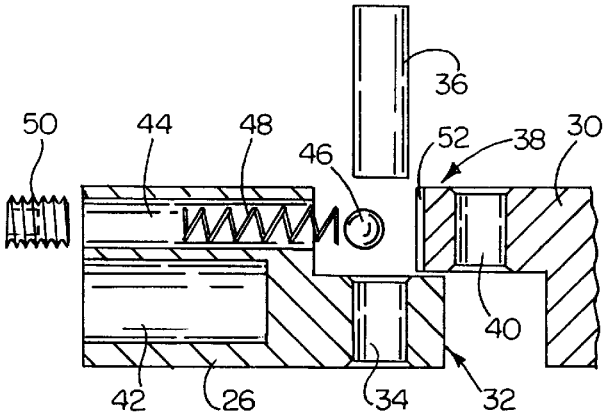
FIG. 3 is a cross-sectional, exploded view of a portion of the hinge assembly shown in FIG. 2.
Figure 2:
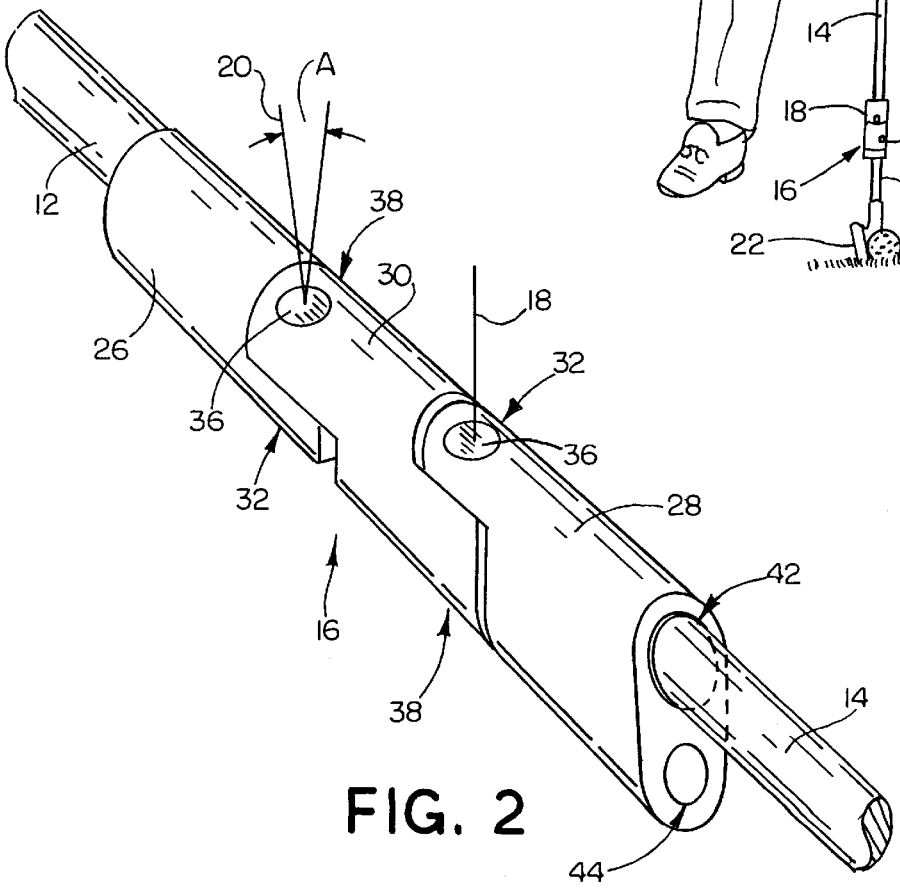
FIG. 2 is an illustration of a hinge assembly in accordance with one embodiment of the invention.

One exemplary hinge assembly 16 is shown in FIGS. 2 and 3 as a three piece hinge, although other hinge assemblies performing substantially the same function may be used as would be readily appreciated. The hinge assembly 16 includes a pair of hinge ends 26 and 28 and an interconnecting element 30. Each hinge end 26, 28 is generally oval in cross-section and includes a mating flange 32 having a through bore 34 adapted to receive a pin 36 for mating engagement with a similar mating flange 38 of the interconnecting element 30 having a through bore 40. The interconnecting element 30 will of course have two mating flanges 38 with one on either side of the interconnecting element for hinged connection with one of the hinge ends.

Each hinge end 26 and 28 further includes a pair of parallel bores 42 and 44, one bore 42 extending only partly through the hinge end and adapted to receive and secure a shaft section 12 such as by gluing and the other bore 44 extending through the hinge end to receive a ball bearing 46, a spring 48 and a set screw 50.

The ball bearing 46, the spring 48 and set screw 50 retained in the bore 44 along with a detent 52 in the interconnecting element 30 cooperatively form an adjustable biasing mechanism for biasing the shaft sections 12 and 14 in longitudinal or unbroken alignment. The detent 52 may be in an angular or semi-cylindrical shape and size so as to retain a portion of the ball bearing 50, thus resisting articulation of the hinge assembly 16, while allowing the ball bearing to be forced back into the bore 44 and the hinge assembly to articulate under a sufficient torsional force on the hinge caused by a swing defect. By adjusting the position of the set screw 50, the force that the spring 48 exerts on the ball bearing 46 and that the ball bearing in turn exerts on the detent 52 can be adjusted to a desired amount. To facilitate ease of adjustment the set screw preferably includes a receptacle for an allen wrench. Alternatively, the biasing force may not be adjustable or the hinge may be designed to place the adjustment mechanism in a different location. Further, the desired biasing force may be accomplished through other means including a leaf spring, a cantilever spring, etc.

The ease at which the shaft articulates in a forward or backward direction at the hinge element 16 may be the same or different. If it is desired that the force required to articulate the shaft be different in different directions, for example, so that it is harder to make the shaft break on the backswing and easier during the downswing, that can be accomplished by shaping the detent 52 with different face angles in the relative forward or rearward directions.

Although the invention has been shown and described with respect to certain preferred embodiments, it is obvious that equivalent alterations and modifications will occur to others skilled in the art upon the reading and understanding of this specification. The present invention includes all such equivalent alterations and modifications and is limited only by the scope of the following claims.

What is claimed:

1. A golf swing training device, comprising a golf club having a shaft including a hinge assembly having a plurality of hinge elements connected by an interconnected element for allowing the shaft to articulate around two distinct, nonparallel axes.

2. The golf swing training device of claim 1, including a club head.

3. The golf swing training device of claim 1, including a grip.

4. The golf swing training device of claim 1, wherein the shaft selectively articulates about at least one of the axes when the device is swung improperly.

5. The golf swing training device of claim 1, wherein the golf club is a 5 iron.

6. The golf swing training device of claim 1, wherein the golf club is a driver.

7. The golf swing training device of claim 1, wherein each axes facilitates the detection of a different swing imperfection.

8. The golf swing training device of claim 1, wherein the axes are offset from one another rotationally by generally 15 degrees.

9. The golf swing training device of claim 1, wherein the axes are rotationally offset one another from 10 to 20 degrees.

10. A golf swing training device, comprising:

a plurality of elongate shaft sections connected by a plurality of hinge sections enabling the shaft sections to articulate about a plurality of distinct axes;

a club head secured to one of the shaft sections; and a grip connected to another of the shaft sections.

11. The golf swing training device of claim 10, wherein the hinge sections include a biasing element which bias the hinge sections to maintain the shaft sections axially aligned when the device is swung properly and to allow the shaft sections to articulate about at least one of the axes when the device is swung improperly.

12. The golf swing training device of claim 10, wherein the axes are not parallel and facilitate the detection of different swing imperfections.

13. The golf swing training device of claim 10, wherein the club head is the head of a 5 iron.

14. The golf swing training device of claim 10, wherein the club head is the head of a driver.

15. A golf swing training device, comprising:

a plurality of elongate shaft sections connected by a hinge apparatus having a plurality of interconnected elements allowing the shaft to articulate about plural distinct hinge axes;

a club head secured to one of the shaft sections; and a grip connected to another of the shaft sections;

wherein the hinge axes are not parallel and facilitate the detection of different swing imperfections.

16. The golf swing training device of claim 15, wherein the hinge apparatus includes a plurality of biasing elements which bias the hinge apparatus to maintain the shaft sections axially aligned when the device is swung properly and to allow the shaft sections to articulate about at least one of the axes when the device is swung improperly.

17. A golf swing training device, comprising a golf club having a shaft including a hinge assembly having a plurality of hinge elements connected by an interconnected element for allowing the shaft to articulate around two distinct, parallel axes.

* * * * *